US010101760B1

(12) United States Patent
Huang et al.

(10) Patent No.: US 10,101,760 B1
(45) Date of Patent: Oct. 16, 2018

(54) POWER-ON CONTROL CIRCUIT AND INPUT/OUTPUT CONTROL CIRCUIT

(71) Applicant: Vanguard International Semiconductor Corporation, Hsinchu (TW)

(72) Inventors: Shao-Chang Huang, Hsinchu (TW); Jung-Tsun Chuang, Tainan (TW); Chieh-Yao Chuang, Kaohsiung (TW); Hung-Wei Chen, Jhubei (TW)

(73) Assignee: Vanguard International Semiconductor Corporation, Hsinchu (TW)

( * ) Notice: Subject to any disclaimer, the term of this patent is extended or adjusted under 35 U.S.C. 154(b) by 0 days.

(21) Appl. No.: 15/471,756

(22) Filed: Mar. 28, 2017

(51) Int. Cl.
*G05F 1/59* (2006.01)
*G05F 1/575* (2006.01)

(52) U.S. Cl.
CPC ..... *G05F 1/59* (2013.01); *G05F 1/575* (2013.01)

(58) Field of Classification Search
CPC ..... G05F 1/575; G05F 1/59
USPC ..... 327/142, 143
See application file for complete search history.

(56) References Cited

U.S. PATENT DOCUMENTS 5,430,389 A * 7/1995 Kamiya ..... H03K 19/00361 326/17
2008/0100351 A1 5/2008 Choi
2009/0206891 A1 8/2009 Guimont
2011/0074470 A1 3/2011 Sanborn et al.

FOREIGN PATENT DOCUMENTS

TW 200707907 A 2/2007

* cited by examiner

*Primary Examiner* — William Hernandez
(74) *Attorney, Agent, or Firm* — Birch, Stewart, Kolasch & Birch, LLP

(57) ABSTRACT

A power-on control circuit is provided. The power-on control circuit includes first and second power terminals, a switch circuit, an inverter chain circuit, and a capacitor. The switch circuit has a control terminal receiving a first control signal, an input terminal coupled to the second power terminal, and an output terminal coupled to a first node. The inverter chain circuit has an input terminal coupled to the first node and generates the first control signal. The capacitor is coupled between the first node and a ground. When the first power terminal receives a first voltage and the second power terminal does not receive a second voltage, the switch circuit is turned on according to the first control signal. When the first power terminal receives the first voltage and the second power terminal receives the second voltage, the switch circuit is turned off according to the first control signal.

22 Claims, 9 Drawing Sheets

POWER-ON CONTROL CIRCUIT AND INPUT/OUTPUT CONTROL CIRCUIT

BACKGROUND OF THE INVENTION

Field of the Invention

The invention relates to a power-on control circuit, and, more particularly, to power-on control circuit with less leakage current.

Description of the Related Art

In some integrated circuits, output-end circuits may be powered by different voltages at the same time. For example, an output stage circuit coupled to an input/output pad is powered by a voltage 3.3V, while a control circuit used to control the output stage circuit is powered by a voltage 1.8V. In cases where the voltage 3.3V has been supplied and the voltage 1.8V has not been supplied yet, since the control circuit does not operate, the input terminal of the output stage circuit is floating, which induces a leakage current in the output stage circuit. In order to eliminate this leakage current in the output stage circuit, a power-on circuit is provided to cut off the path of the leakage current. However, generally, there is a leakage current generated in the power-on circuit when both the voltage 3.3V and the voltage 1.8V are supplied, which result in additional power consumption.

BRIEF SUMMARY OF THE INVENTION

An exemplary embodiment of a power-on control circuit for generating a first control signal to control an output stage circuit is provided. The power-on control circuit comprises a first power terminal, a second power terminal, a switch circuit, an inverter chain circuit, and a capacitor. The first power terminal is reconfigured to receive a first voltage. The second power terminal is reconfigured to receive a second voltage. The switch circuit has a control terminal receiving the first control signal, an input terminal coupled to the second power terminal, and an output terminal coupled to a first node. The inverter chain circuit is coupled to the first power terminal. The inverter chain circuit has an input terminal coupled to the first node and generates the first control signal. The capacitor is coupled between the first node and a ground. When the first power terminal receives the first voltage and the second power terminal does not receive the second voltage, the switch circuit is turned on according to the first control signal. When the first power terminal receives the first voltage and the second power terminal receives the second voltage, the switch circuit is turned off according to the first control signal.

An exemplary embodiment of an input/output control circuit is provided. The input/output control circuit is coupled to an input/output pad. The input/output control circuit comprises a first power terminal, a second power terminal, an output stage circuit, and a power-on control circuit. The first power terminal is reconfigured to receive a first voltage. The second power terminal is reconfigured to receive a second voltage. The output stage circuit is coupled to the input/output pad and the first power terminal and controlled by a first control signal. The power-on control circuit is coupled to the output stage circuit and configured to generate the first control signal. The power-on control circuit comprises a switch circuit, an inverter chain circuit, and a capacitor. The switch circuit has a control terminal receiving the first control signal, an input terminal coupled to the second power terminal, and an output terminal coupled to a first node. The inverter chain circuit is coupled to the first power terminal. The inverter chain circuit has an input terminal coupled to the first node and generates the first control signal. The capacitor is coupled between the first node and a ground. When the first power terminal receives the first voltage and the second power terminal does not receive the second voltage, the switch circuit is turned on according to the first control signal. When the first power terminal receives the first voltage and the second power terminal receives the second voltage, the switch circuit is turned off according to the first control signal.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
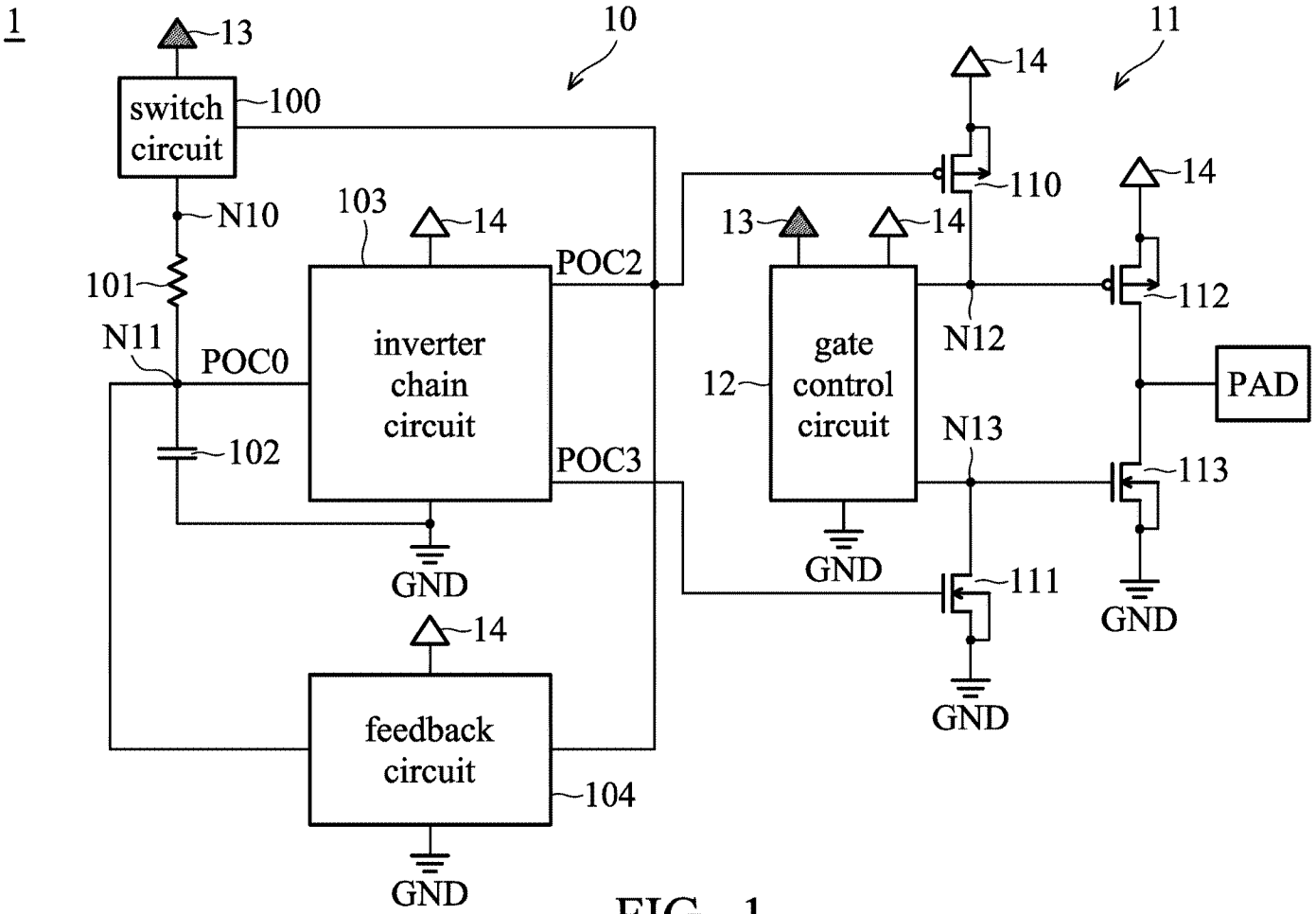
FIG. 1 shows one exemplary embodiment of an input/output control circuit.

FIG. 1 shows an exemplary embodiment of an input/output control circuit. Referring to FIG. 1, an input/output control circuit 1 is a part of an output-end circuit of an integrated circuit and coupled to an input/output pad PAD of the integrated circuit. The input/output control circuit 1 comprises a power-on control circuit 10, an output stage circuit 11, and a gate control circuit 12. The power-on control circuit 10 comprises a switch circuit 100, a resistor 11, a capacitor 102, an inverter chain circuit 103, and a feedback circuit 104. The output stage circuit 11 comprises P-type metal-oxide-semiconductor (PMOS) transistors 110 and 112 and N-type metal-oxide-semiconductor (NMOS) transistors 111 and 113. The control terminal of the switch circuit 100 receives a control signal POC2, the input terminal thereof is coupled to a power terminal 13, and the output thereof is coupled to a node N10. The turned-on/off state of the switch circuit 100 is coupled by the control signal POC2. The resistor 101 is coupled between the node N10 and a node N11. The capacitor 102 is coupled between the node N11 and the ground GND. The inverter chain circuit 103 is coupled to a power terminal 14 and the ground GND. The inverter chain circuit 103 comprises a plurality of inverters. The input terminal of the inverter chain circuit 103 is coupled to the node N10. The inverter chain circuit 103 generates control signal POC2 and POC3, which are inverse to each other, according to the voltage at the node N10. The feedback circuit 104 is coupled between the inverter chain circuit 103 and the node N11. The feedback circuit 104 is capable of changing the voltage level of the control signal POC0 at the node N1 according to the control signal POC2.

The gate of the PMOS transistor 110 receives the control signal POC2, the source thereof is coupled to the power terminal 14, and the drain thereof is coupled to a node N12. The gate of the NMOS transistor 111 receives the control signal POC3, the drain thereof is coupled to a node N13, and the source thereof is coupled to the ground GND. The gate of the PMOS transistor 112 is coupled to the node N12, the source thereof is coupled to the power terminal 14, and the drain thereof is coupled to the input/output pad PAD. The gate of the NMOS transistor 113 is coupled to the node N13, the drain thereof is coupled to input/output PAD, and the source thereof is coupled to the ground GND. The gate control circuit 12 is coupled to the power terminals 13 and 14. The gate control circuit 12 is also coupled to the nodes N12 and 13. The gate control circuit 12 provides gate control signals to the gate of the PMOS transistor 112 and the gate of the NMOS transistor 113 respectively.

The power terminals 13 and 14 receive different voltages. For example, the power terminal 13 is capable of receiving a voltage 1.8V (volt), while the power terminal 14 is capable of receiving a 3.3V voltage. Under the same conditions, the power terminal 14 has received the 3.3V voltage, but the power terminal 13 has not received the voltage 1.8V. For example, the 1.8V voltage is generated from a power converter by performing a buck operation on the 3.3V voltage. Thus, the power terminal 13 receives the voltage later than the power terminal 14. In the embodiment, when the power terminal 14 has received the 3.3V voltage and the power terminal 13 has not received the voltage 1.8V (that is, the power terminal 13 is at 0V), the input/output control circuit 1 operates in a power-on control stage. The moment the input/output control circuit 1 enters the power-on control stage, the voltage level of the control signal POC0 at the node N11 is at 0V, and the inverter chain circuit 103 generates the control signal POC2 with a voltage level of 0V and the control signal POC3 with a voltage level of 3.3V according to the control signal POC0 (0V) at the node N11. Thus, the control signal POC2 is at a low voltage level, while the control signal POC3 is at a high voltage level; that is, the voltage level of the control signal POC2 is the inverse of the voltage level of the control signal POC3. At this time, the switch circuit 100 is turned on according to the control signal POC2 with a voltage level of 0V. The PMOS transistor 110 and the NMOS transistor 111 are turned on according to the control signals POC2 and POC3 respectively. Thus, the nodes N12 and N13 are at the 3.3V voltage and the 0V voltage to turn off the PMOS transistor 112 and the NMOS transistor 113, respectively. Moreover, since the power terminal 13 has not received the voltage 1.8V and then the gate control circuit 12 does not operate, the turned-on/off states of the PMOS transistor 112 and the NMOS transistor 113 are not controlled by the gate control circuit 12. Accordingly, in the power-on control stage, since the PMOS transistor 112 and the NMOS transistor 113 are turned off, the leakage-current path between the power terminal 14 and the ground GND in the output stage circuit 11 is cut off, which avoids generating a driving leakage current. Moreover, in the power-on control stage, the feedback circuit 104 does not change the voltage level at the node N11 according to the control signal POC2.

When the power terminal 14 has received the 3.3V voltage and the power terminal 13 has received the 1.8V voltage, the input/output control circuit 1 operates in a stable stage. The moment the input/output control circuits 1 enter the stable state from the power-on control stage, the control signal POC2 is still at 0V, and the switch circuit 100 is turned on according to the control signal POC2. At this time, the voltage level of the control signal POC0 at the node N11 is switched to 1.8V, and the inverter chain circuit 103 generates the control signal POC2 whose voltage level is at 3.3V and the control signal POC3 whose voltage level is at 1.8V according to the control signal POC0 (1.8V) at the node N11. Thus, the control signal POC2 is at a high voltage level, while the control signal POC3 is at a low voltage level. At this time, the control signal POC2 with the voltage level of 3.3V turns off the switch circuit 100, and the feedback circuit 104 provides a feedback path to, according to the control signal POC2, change the voltage level of the control signal POC0 at the node N11 to be the voltage level of the control signal POC2; that is, the voltage of 3.3V. Since the voltage level of the control signal POC0 is switched from 1.8V to 3.3V, the input terminal of the inverter chain circuit 103 is also at 3.3V, thereby cutting off a leakage current between the power terminal 12 and the ground GND in the inverter chain circuit 14. Moreover, in the stable stage, the PMOS transistor 110 and the NMOS transistor 110 are turned off according to the control signals POC2 and POC3 respectively. At this time, since the gate control circuit 12 is powered by the voltage 1.8V through the power terminal 13 and by the 3.3V voltage through the power terminal 14 and operates normally, the turned-on/off states of the PMOS transistor 112 and the NMOS transistor 113 are controlled by the gate control circuit 12.

According to the above embodiment, in the power-on control stage and the stable stage, the input/output control circuit 1 avoids generating leakage currents by cutting off the leakage-current paths, thereby decreasing unnecessary power consumption. The operation of the input/output control circuit 1 will be described in various embodiments in the following paragraphs.

Figure 2A:
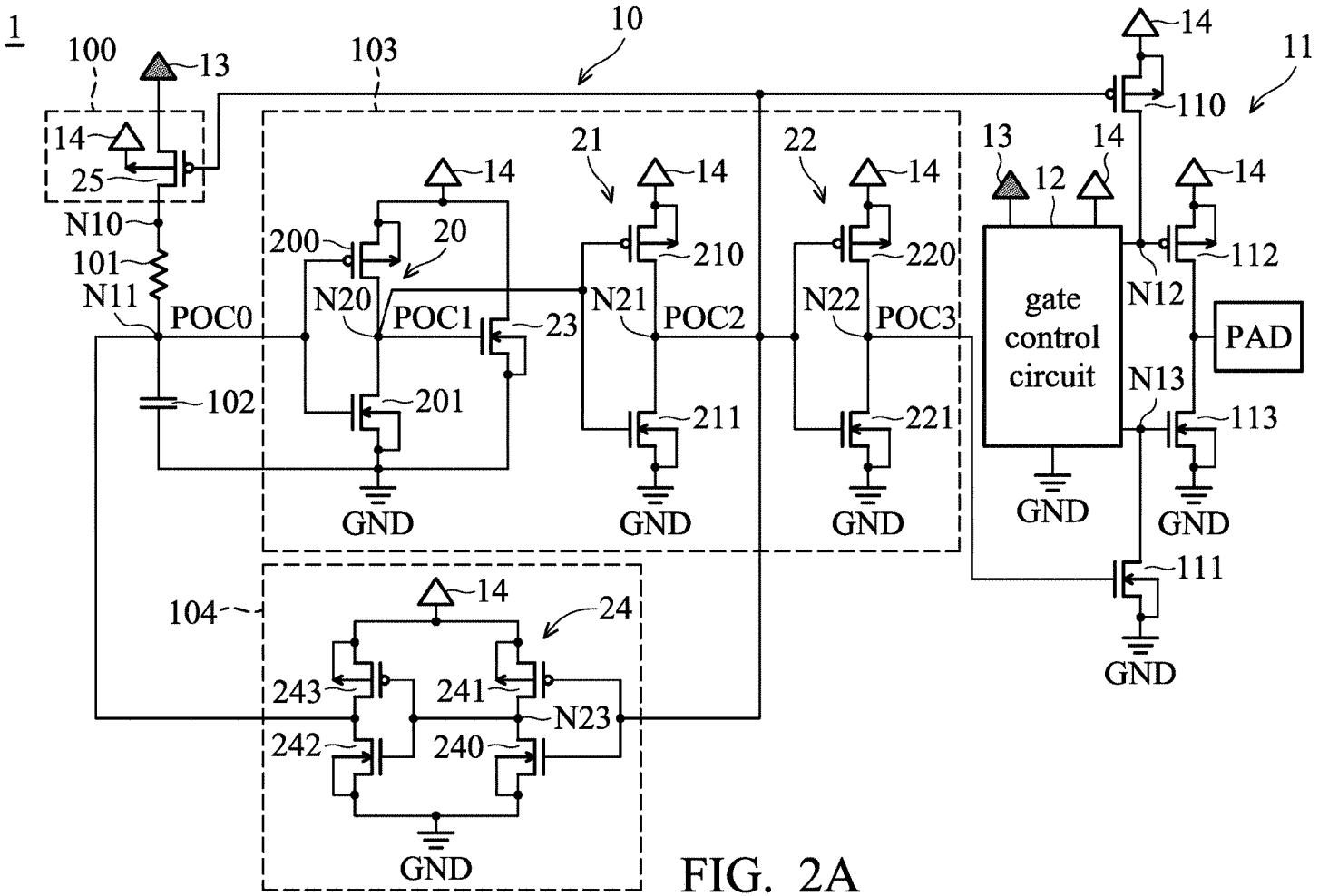
FIG. 2A shows another exemplary embodiment of an input/output control circuit.

FIG. 2A shows another exemplary embodiment of an input/output control circuit. Referring to FIG. 2A, the switch circuit 100 comprises a PMOS transistor 25. The gate of the PMOS transistor 25 receives the control signal of the switch circuit 100 to receive the control signal POC2, and the drain thereof is coupled to the input terminal of the switch circuit 100 (that is, the drain thereof is coupled to the power terminal 13), and the source thereof is coupled to the output terminal of the switch circuit 100 (that is, the source thereof is coupled to the node N10). The bulk of the PMOS transistor 25 is coupled to the power terminal 4. The inverter chain circuit 103 comprises inverting circuits 20-22 and an NMOS transistor 23. The inverting circuit 20 comprises a PMOS transistor 200 and an NMOS transistor 201. The inverting circuit 21 comprises a PMOS transistor 210 and an NMOSD transistor 211. The inverting circuit 22 comprises a PMOS transistor 220 and an NMOSD transistor 221. The gate of the PMOS transistor 200 is coupled to the input terminal of the inverter chain circuit 103 (that is, the gate thereof is coupled to the node N11), the source thereof is coupled to the power terminal 14, and the drain thereof is coupled to a node N20. The gate of the NMOS transistor 201 is coupled to the input terminal of the inverter chain circuit 103 (that is, the gate thereof is coupled to the node N11), the drain thereof is coupled to the node N20, and the source thereof is coupled to the ground GND. According to the structure of the inverting circuit 20, the node N11 serves as the input terminal of the inverting circuit 20, while the node N20 serves as the output terminal of the inverting circuit 20. The gate of the NMOS transistor 23 is coupled to the node N20, the drain thereof is coupled to the power terminal 14, and the source thereof is coupled to the ground GND. The gate of the PMOS transistor 210 is coupled to the node N20, the source thereof is coupled to the power terminal 14, and the drain thereof is coupled to a node N21. The gate of the NMOS transistor 211 is coupled to the node N20, the drain thereof is coupled to the node N21, and the source thereof is coupled to the ground GND. According to the structure of the inverting circuit 21, the node N20 serves as the input terminal of the inverting circuit 21, while the node N21 serves as the output terminal of the inverting circuit 21. The gate of the PMOS transistor 220 is coupled to the node N21, the source thereof is coupled to the power terminal 14, and the drain thereof is coupled to a node N22. The gate of the NMOS transistor 211 is coupled to the node N21, the drain thereof is coupled to the node N22, and the source thereof is coupled to the ground GND. According to the structure of the inverting circuit 22, the node N21 serves as the input terminal of the inverting circuit 22, while the node N22 serves as the output terminal of the inverting circuit 22. The inverter chain circuit 103 generates the control signal POC1 at the node N20, the control signal POC2 at the node N21, and the control signal POC3 at the node N22. The NMOS transistor 23 is capable of providing an electrostatic discharge (ESD) path when an ESD event occurs.

Referring to FIG. 2A, the feedback circuit 104 comprises a buffering circuit 24. The input terminal of the buffering circuit 24 is coupled to the node N21, and the output terminal thereof is coupled to the node N11. The buffering circuit 21 receives the control signal POC2 through the node N21 and buffers the control signal POC2 to the node 11, thereby controlling the voltage level of the control signal POC0. The buffering circuit 24 comprises NMOS transistors 240 and 242 and PMOS transistors 241 and 243. The gate of the PMOS transistor 241 is coupled to the input terminal of the buffering circuit 24, the source thereof is coupled to the power terminal 14, and the drain thereof is coupled to a node N23. The gate of the NMOS transistor 240 is coupled to the input terminal of the buffering circuit 24, the drain thereof is coupled to the node N23, and the source thereof is coupled to the ground GND. The gate of the PMOS transistor 243 is coupled to the node N23, the source thereof is coupled to the power terminal 14, and the drain thereof is coupled to the output terminal of the buffering circuit 24. The gate of the NMOS transistor 242 is coupled to the node N23, the drain thereof is coupled to the output terminal of the buffering circuit 24, and the source thereof is coupled to the ground GND. The NMOS transistors 240 and 242 and the PMOS transistors 241 and 243 cooperate to buffer the voltage or signal at the node N23. Details of the operation of the input/output control circuit 1 in the embodiment of FIG. 1 will be described in the following paragraphs.

Figure 2B:
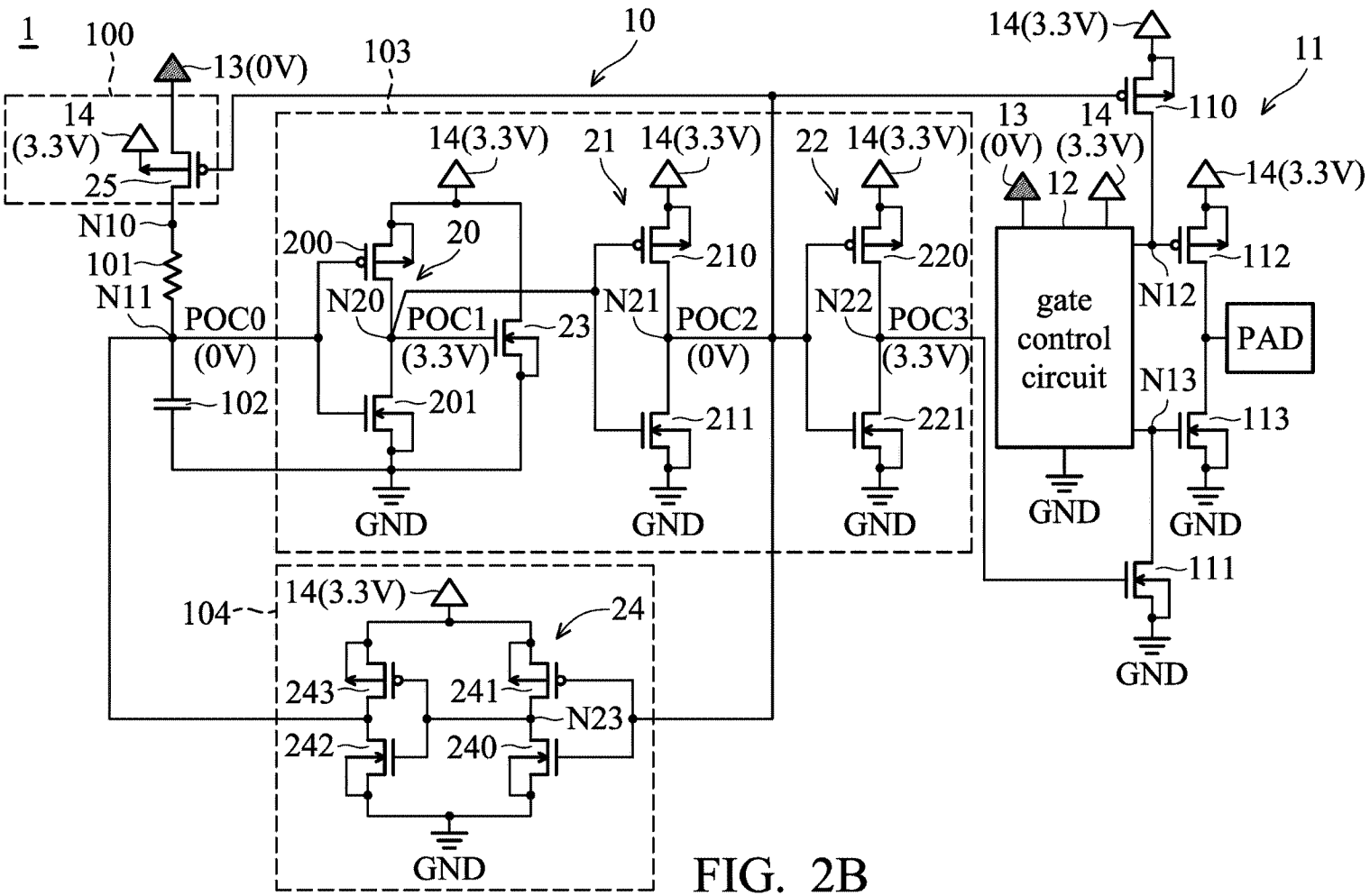
FIG. 2B is a schematic view showing the operation of the input/output control circuit of FIG. 2A in a power-on control stage.

Referring to FIG. 2B, when the power terminal 14 has received the 3.3V voltage and the power terminal 13 has not received the 1.8V voltage (that is, the power terminal 13 is at 0V), the input/output control circuit 1 operates in the power-on control stage. The moment the input/output control circuit 1 enters the power-on control stage, the voltage level of the control signal POC0 at the node N11 is at 0V. Through the inverting operations of the inverting circuits 20-22, the inverting circuit 20 generates the control signal POC1 with the voltage level of 3.3V at the node N20, the inverting circuit 21 generates the control signal POC2 with the voltage level of 0V at the node N22, and the inverting circuit 22 generates the control signal POC3 with the voltage level of 3.3V at the node N22. At this time, the PMOS transistor 25 is turned on according to the control signal POC2 with the voltage level of 0V, so that the voltage level of the control signal POC0 at the node N11 is still at 0V. The PMOS transistor 110 and the NMOS transistor 111 are turned on according to the control signals POC2 and POC3 respectively. Accordingly, the nodes N12 and N13 are at the 3.3V voltage and the 0V voltage to turn off the PMOS transistor 112 and the NMOS transistor 113, respectively. Moreover, since the power terminal 13 has not received the voltage 1.8V and then the gate control circuit 12 does not operate, the turned-on/off states of the PMOS transistor 112 and the NMOS transistor 113 are not controlled by the gate control circuit 12 in the power-on stage. Accordingly, in the power-on control stage, since the PMOS transistor 112 and the NMOS transistor 113 are turned off, the leakage-current path between the power terminal 14 and the ground GND in the output stage circuit 11 is cut off, which avoids generating a driving leakage current.

Moreover, referring to FIG. 2B, in the power-on control stage, the buffering circuit 24 of the feedback circuit 104 receives the voltage signal POC2 with the voltage level of 0V. Through the buffering operation of the buffering circuit 24, the output of the buffering circuit 24 is at the level voltage of 0V. The control voltage POC0 at the node N11 is kept at the voltage level of 0V. In other words, the feedback circuit 104 does not change the voltage level at the node N11.

Figure 2C:
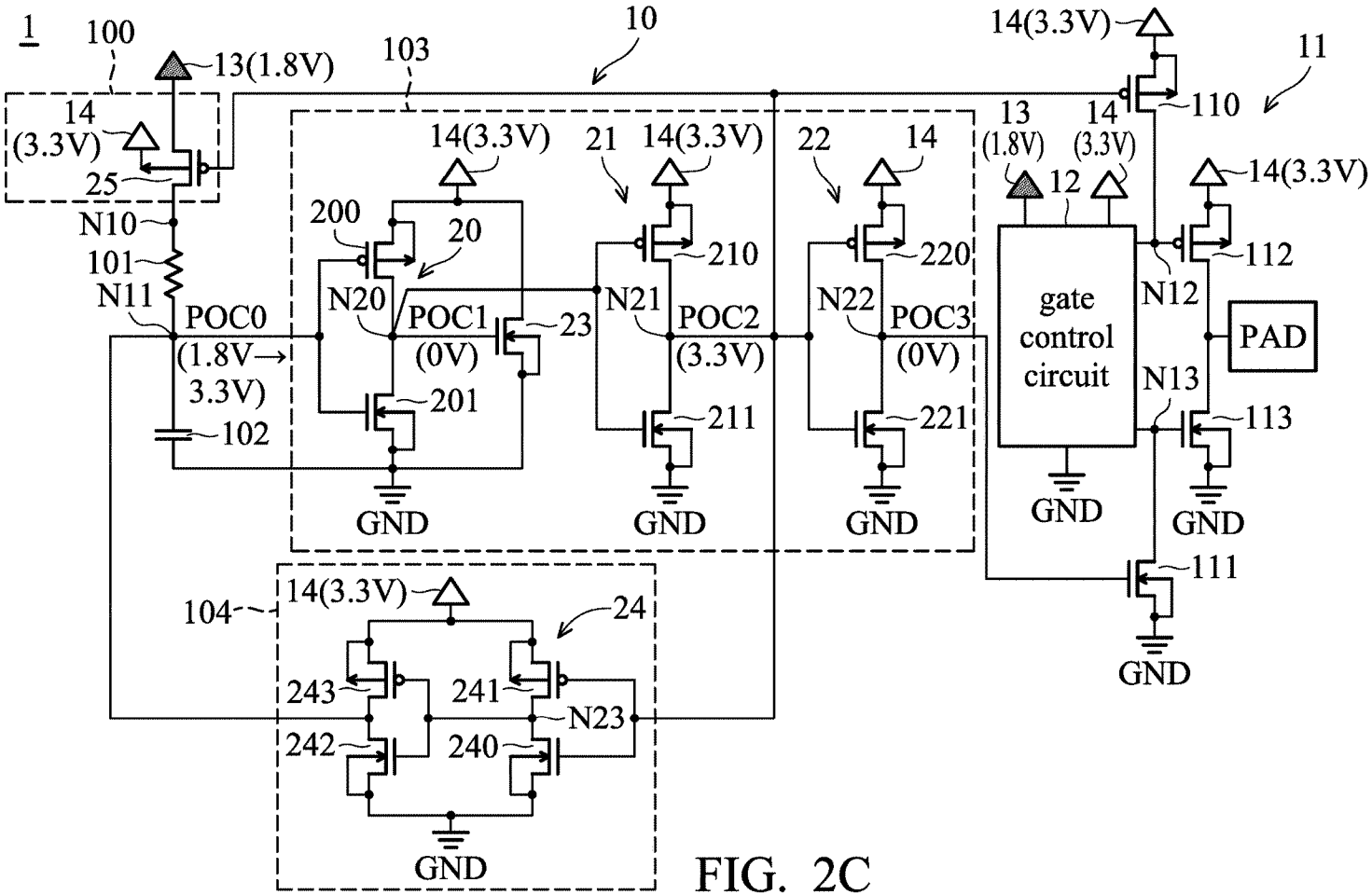
FIG. 2C is a schematic view showing the operation of the input/output control circuit of FIG. 2A in a stable stage.

Referring to FIG. 2C, when the power terminal 14 has received the 3.3V voltage and the power terminal 13 has received the 1.8V voltage, the input/output control circuit 1 operates in the stable stage. The moment the input/output control circuit 1 enters the stable state from the power-on control stage, the control signal POC2 is still at 0V, and the PMOS transistor 25 is still turned on according to the control signal POC2 with the voltage level of 0V. Through the inverting operations of the inverting circuits 20-22, the inverting circuit 20 generates the control signal POC1 with the voltage level of 0V at the node N20, the inverting circuit 21 generates the control signal POC2 with the voltage level of 3.3V at the node N21, and the inverting circuit 22 generates the control signal POC3 with the voltage level of 0V at the node N20. According to the above description, when the input/output control circuit 1 enters the stable state from the power-on control stage, since the gate of the PMOS transistor 200 is at the voltage level of 1.8V and the source thereof is at the voltage level of 3.3V, the PMOS transistor 200 cannot be turned off fully, which results in a leakage current path formed between the power terminal 14 and the ground GND and passing through the transistors 200 and 201. The PMOS transistor 25 is turned off according to the control signal POC2 with the voltage level of 3.3V. In the embodiment, through the operation of the feedback circuit 104, the above leakage current path can be cut off, and the relevant operations are described in the following. Referring to FIG. 4C, the buffering circuit 24 of the feedback circuit 104 receives the control signal POC2 with the voltage level of 3.3V, Through the buffering operation of the buffering circuit 24, the voltage level at the node N11 rises to 3.3V from 1.8V. In other words, in the stable stage, the feedback circuit 104 provides a feedback path to change the voltage level of the control signal POC0 at the node N11 according to the control signal POC2, so that the voltage level of the control signal POC0 is changed to the voltage level of the control signal POC2; that is, the voltage level of 3.3V. Since both the gate and source of the PMOS transistor 200 are at the voltage level of 3.3V, the PMOS transistor 200 can be turned off fully, thereby cutting off the leakage current path formed between the power terminal 14 and the ground GND and passing through the transistors 200 and 201.

Moreover, referring to FIG. 2C, in the stable stage, the PMOS transistor 110 and the NMOS transistor 110 are turned off according to the control signals POC2 and POC3 respectively. Since the gate control circuit 12 is powered by the 1.8V voltage through the power terminal 13 and by the 3.3V voltage through the power terminal 14 and then operates normally, the turned-on/off states of the PMOS transistor 112 and the NMOS transistor 113 are controlled by the gate control circuit 12.

According to the above description, through the operation of the power-on control circuit 10, not only is the leakage current path formed in the output stage circuit 11 in the power-on stage cut off, but the leakage current path formed in the inverter chain circuit 103 in the stable stage is also cut off.

Figure 3:
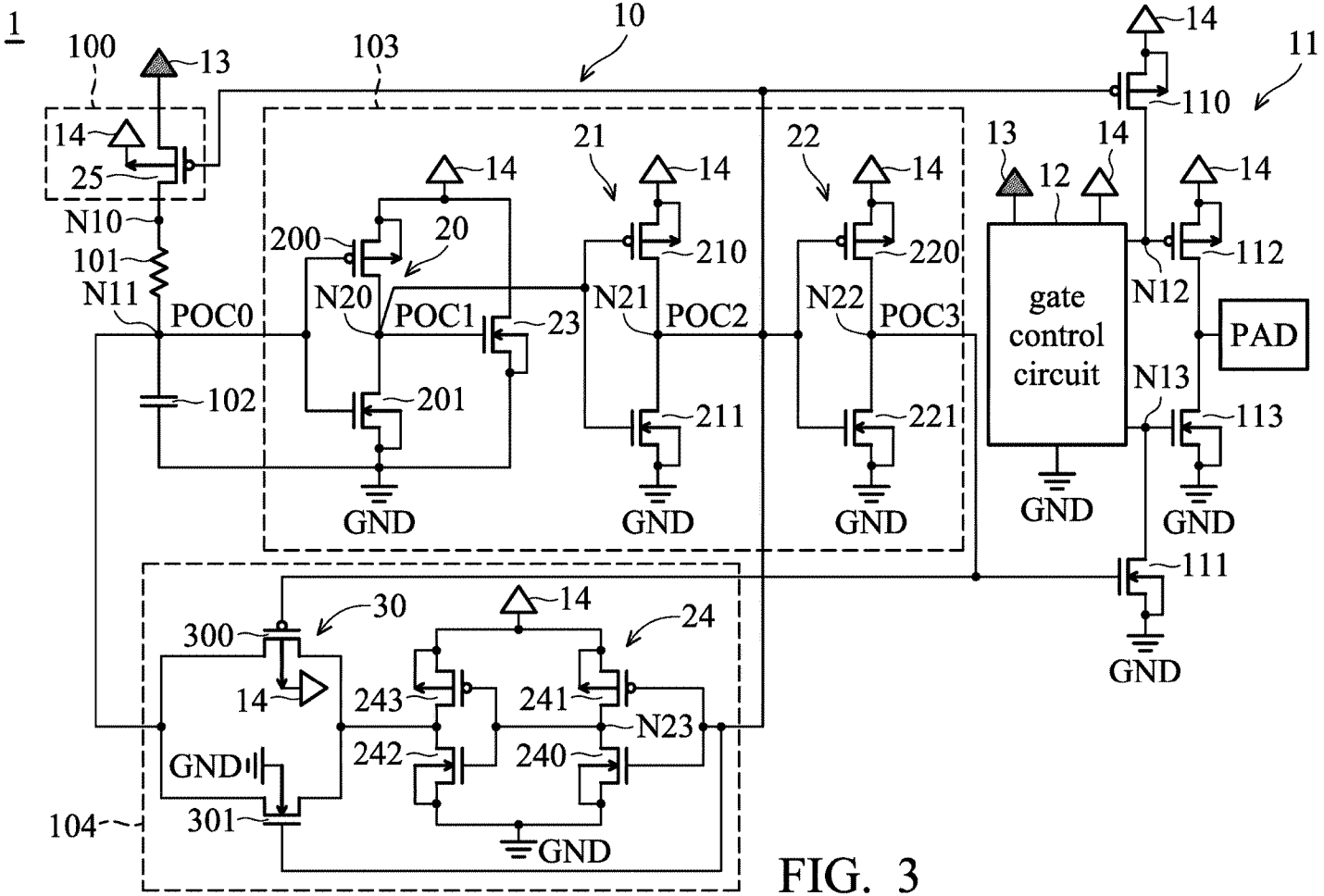
FIG. 3 shows another exemplary embodiment of an input/output control circuit.

In the embodiment of FIGS. 2A-2C, the feedback circuit 104 comprises only the buffering circuit 24. In other words, the feedback circuit 104 may further comprise a transmission gate which is controlled by at least one control signal, such as the control signal POC2. In an embodiment, referring to FIG. 3, the feedback circuit 104 further comprises a transmission gate 30 which is coupled between the output terminal of the buffering circuit 24 and the node N11. The transmission gate 30 comprises a PMOS transistor 300 and an NMOS transistor 301. The gate of the PMOS transistor 300 receives the control signal POC3, the source thereof is coupled to the output terminal of the buffering circuit 24 (that is, the source thereof is coupled to the sources of the transistors 242 and 243), and the drain thereof is coupled to the node N11. The gate of the NMOS transistor 301 receives the control signal POC2, the drain thereof is coupled to the output terminal of the buffering circuit 24 (that is, the source thereof is coupled to the sources of the transistors 242 and 243), and the source thereof is coupled to the node N11. In the embodiment of FIG. 3, the operations of the circuits and elements, which are labeled with the same reference signs as the circuits and elements in the embodiments of FIGS. 2A-2C, in the power-on control stage and the stable stage are the same as those in the embodiment of FIGS. 2A-2C. Thus, the related description is omitted here. The operation of the transmission gate 30 is described in the following. In the power-on control stage, the PMOS transistor 300 and the NMOS transistor 301 are turned off according to the control signal POC3 with the voltage level of 3.3V and the control signal POC2 with the voltage level of 0V respectively. Thus, the feedback circuit 104 does not provide any feedback path between the node N21 and the node N11. Accordingly, the feedback circuit 104 does not change the voltage level at the node N11 according to the control signal POC2. In the stable stage, the PMOS transistor 300 and the NMOS transistor 301 are turned on according to the control signal POC3 with the voltage level of 0V and the control signal POC2 with the voltage level of 3.3V respectively. Thus, the feedback circuit 104 provides a feedback path to, according to the control signal POC2, change the voltage level of the control signal POC0 at the node N11 to be the voltage level of the control signal POC2; that is, the voltage level of 3.3V.

Figure 4:
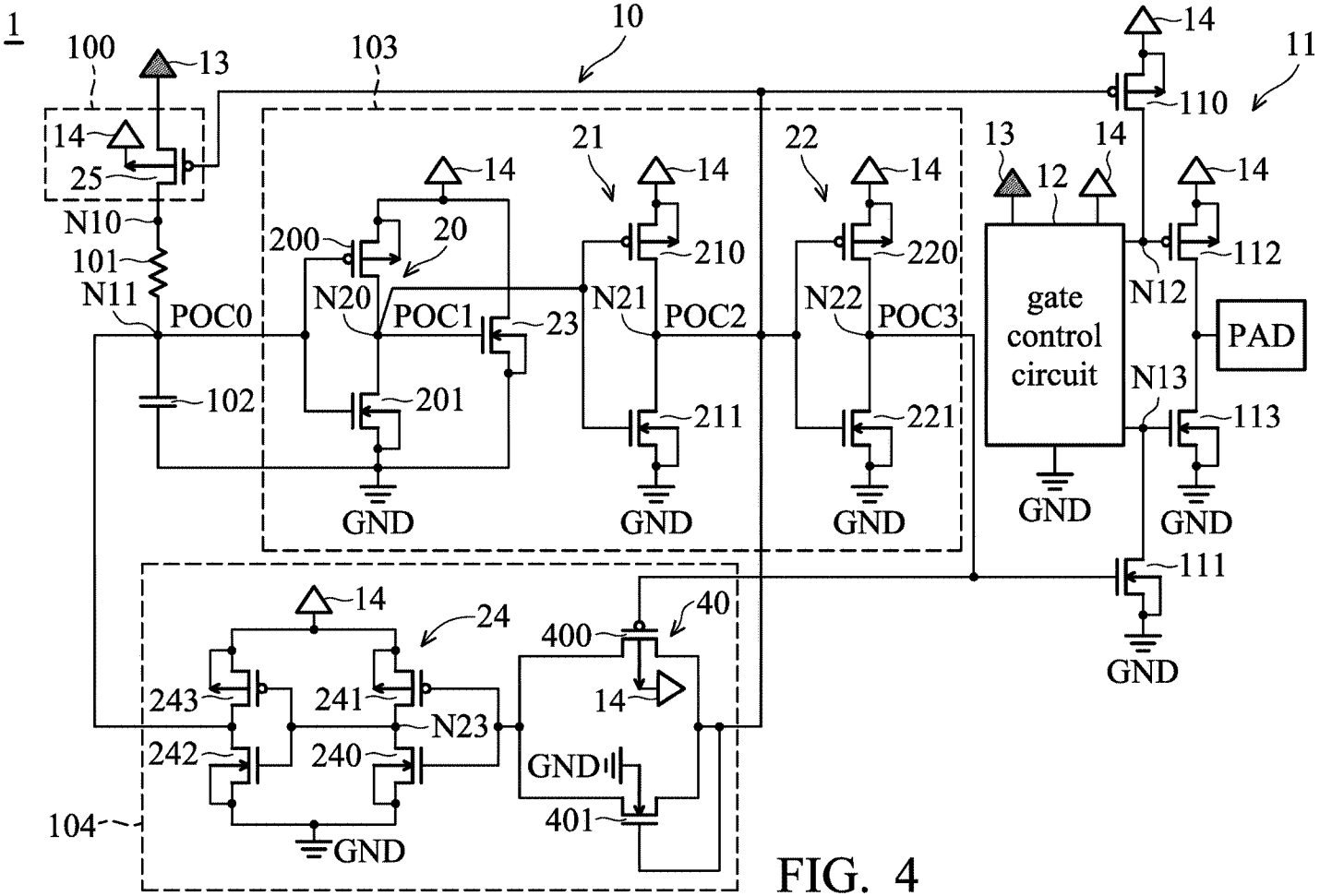
FIG. 4 shows another exemplary embodiment of an input/output control circuit.

In another embodiment, referring to FIG. 4, the feedback circuit 104 further comprises a transmission gate 40 which is coupled between the node N21 and the input terminal of the buffering circuit 24. The transmission gate 40 comprises a PMOS transistor 400 and an NMOS transistor 401. The gate of the PMOS transistor 400 receives the control signal POC3, the source thereof is coupled to the node N21, and the drain thereof is coupled to the input terminal of the buffering circuit 24 (that is, the source thereof is coupled to the gates of the transistors 240 and 241). The gate of the NMOS transistor 401 receives the control signal POC2, the drain thereof is coupled to the node N21, and the source thereof is coupled to the input terminal of the buffering circuit 24 (that is, the source thereof is coupled to the gates of the transistors 240 and 241). In the embodiment of FIG. 4, the operations of the circuits and elements, which are labeled with the same reference signs as the circuits and elements in the embodiments of FIGS. 2A-2C, in the power-on control stage and the stable stage are the same as those in the embodiment of FIGS. 2A-2C. Thus, the relevant description is omitted here. The operation of the transmission gate 40 is described in the following. In the power-on control stage, the PMOS transistor 400 and the NMOS transistor 401 are turned off according to the control signal POC3 with the voltage level of 3.3V and the control signal POC2 with the voltage level of 0V respectively. Thus, the feedback circuit 104 does not provide any feedback path between the node N21 and the node N11. Accordingly, the feedback circuit 104 does not change the voltage level at the node N11 according to the control signal POC2. In the stable stage, the PMOS transistor 400 and the NMOS transistor 401 are turned on according to the control signal POC3 with the voltage level of 0V and the control signal POC2 with the voltage level of 3.3V respectively. Thus, the feedback circuit 104 provides a feedback path to, according to the control signal POC2, change the voltage level of the control signal POC0 at the node N11 to be the voltage level of the control signal POC2; that is, the voltage of 3.3V.

Figure 5:
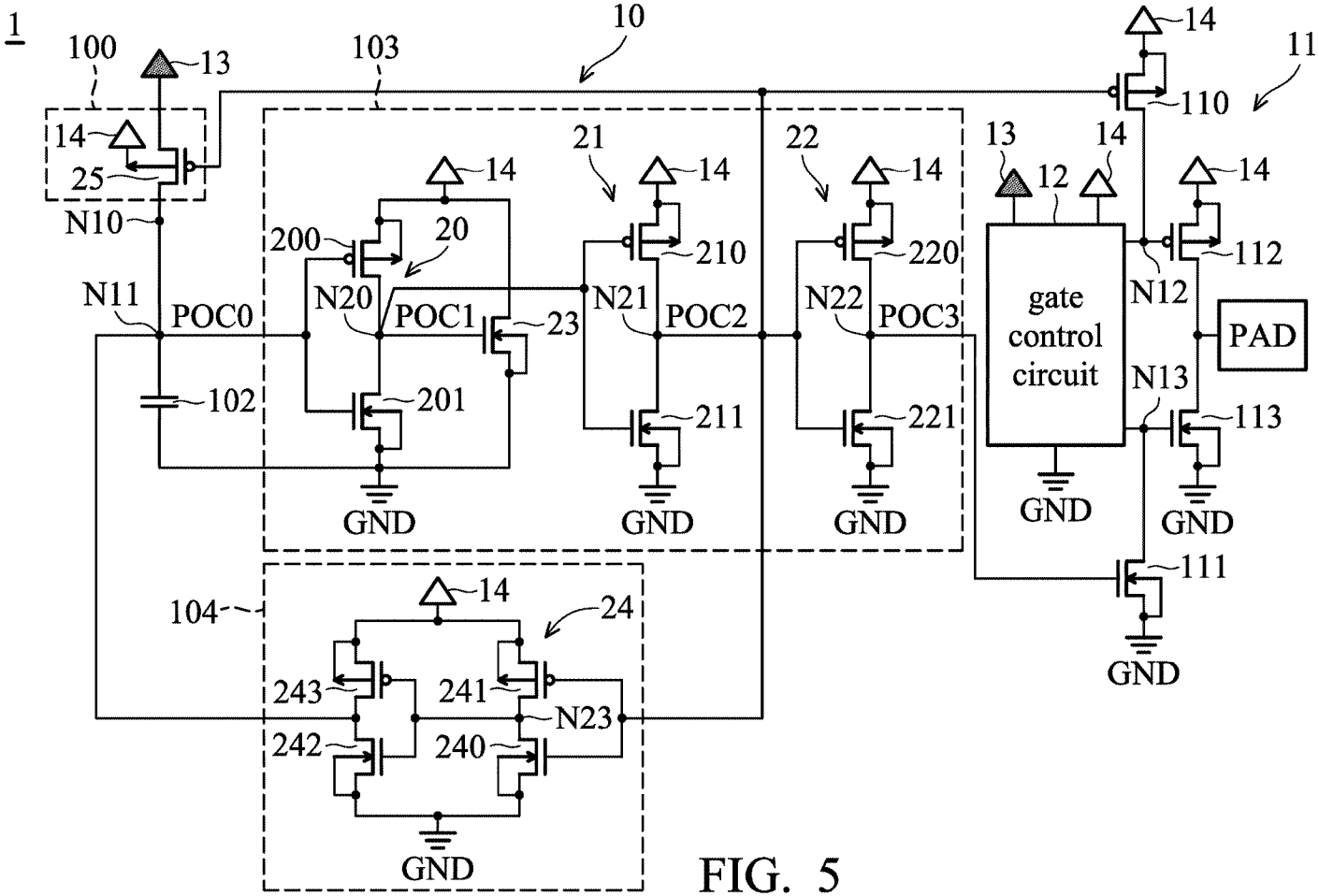
FIG. 5 shows another exemplary embodiment of an input/output control circuit.
Figure 6:
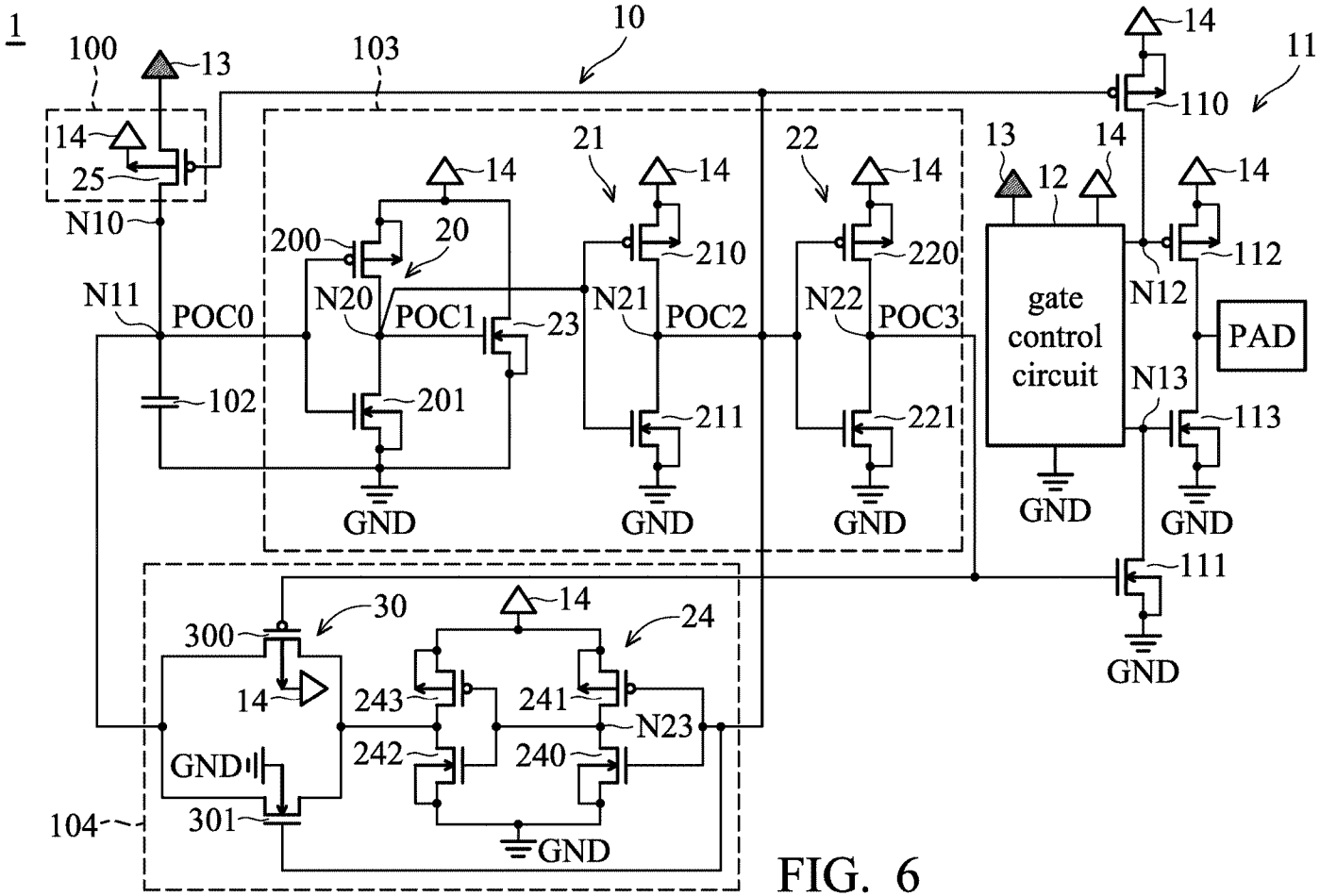
FIG. 6 shows another exemplary embodiment of an input/output control circuit.
Figure 7:
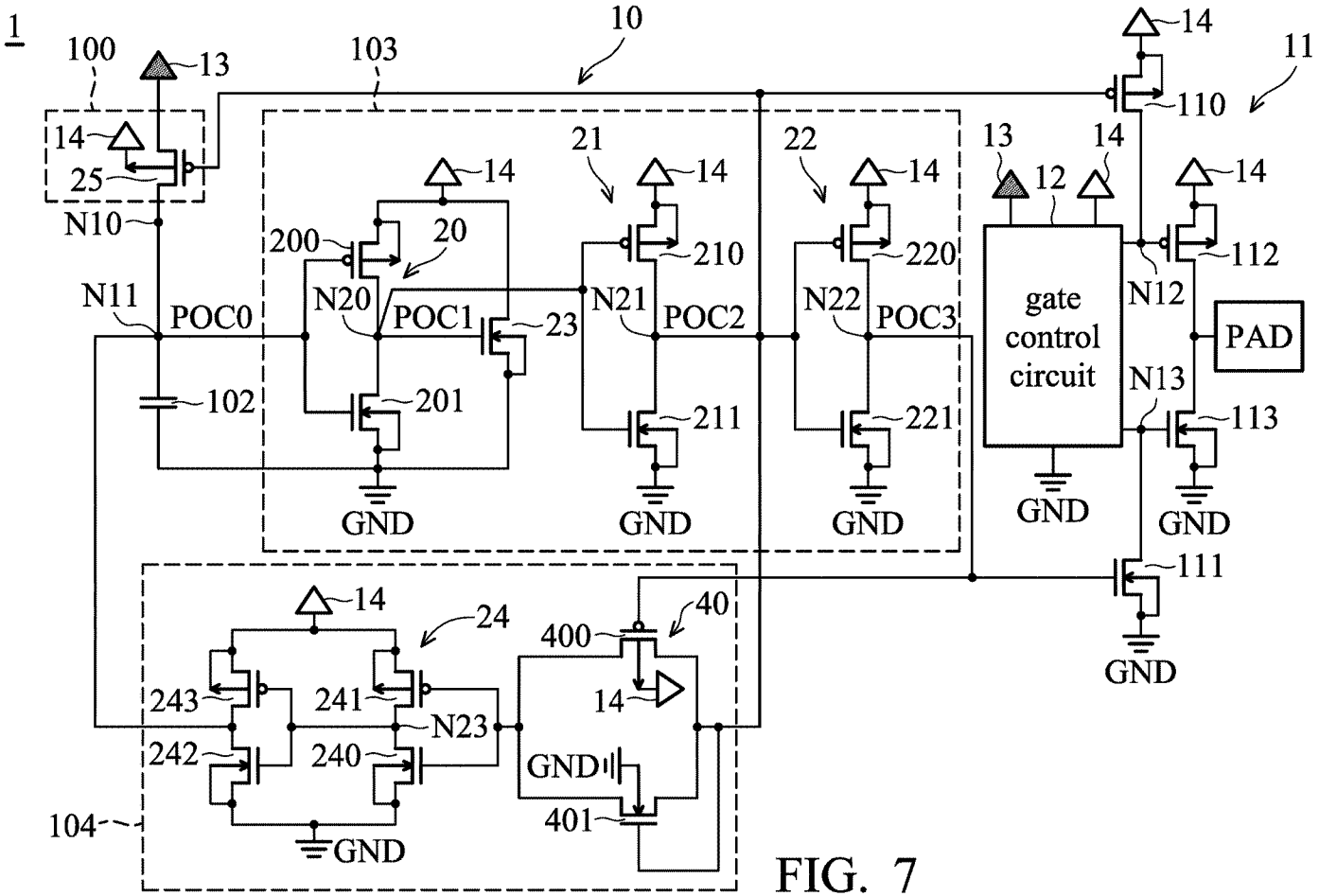
FIG. 7 shows another exemplary embodiment of an input/output control circuit.

In the above embodiments of FIGS. 2A, 3, and 4, the power-on control circuit 10 comprises the resistor 101. In other embodiments, the resistor 101 in the embodiments of FIGS. 2A, 3, and 4 is not included in the power-on control circuit 10, while the resistance derived from the PMOS transistor 25 in the embodiments of FIGS. 2A, 3, and 4 operates as the resistor 101 in the embodiments of FIGS. 2A, 3, and 4. Referring to FIG. 5, compared with the embodiment of FIG. 2A, the power-on control circuit 10 does not comprise the resistor 101 in the embodiment of FIG. 2A. Referring to FIG. 6, compared with the embodiment of FIG. 3, the power-on control circuit 10 does not comprise the resistor 101 in the embodiment of FIG. 3. Referring to FIG. 7, compared with the embodiment of FIG. 4, the power-on control circuit 10 does not comprise the resistor 101 in the embodiment of FIG. 4.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A power-on control circuit for generating a first control signal to control an output stage circuit, comprising:

a first power terminal reconfigured to receive a first voltage;

a second power terminal reconfigured to receive a second voltage;

a switch circuit having a control terminal receiving the first control signal, an input terminal coupled to the second power terminal, and an output terminal coupled to a first node;

an inverter chain circuit, coupled to the first power terminal, having an input terminal coupled to the first node and generating the first control signal; and a capacitor coupled between the first node and a ground, wherein when the first power terminal receives the first voltage and the second power terminal does not receive the second voltage, the switch circuit is turned on according to the first control signal, and wherein when the first power terminal receives the first voltage and the second power terminal receives the second voltage, the switch circuit is turned off according to the first control signal.

2. The power-on control circuit as claimed in claim 1, wherein the first voltage is higher than the second voltage.

3. The power-on control circuit as claimed in claim 1, wherein the switch circuit comprises a P-type transistor, and wherein a bulk of the P-type transistor is coupled to the first power terminal, and a gate, a source, and a drain of the P-type transistor are coupled to the control terminal, the input terminal, and the output terminal of the switch circuit, respectively.

4. The power-on control circuit as claimed in claim 1, further comprising:

a feedback circuit, coupled to the inverter chain circuit and the first node, receiving the first control signal, wherein when the first power terminal receives the first voltage and the second power terminal receives the second voltage, the feedback circuit changes a voltage level at the first node according to the first control signal, and the inverter chain circuit cuts off a leakage current according to the changed voltage level at the first node.

5. The power-on control circuit as claimed in claim 4, wherein the feedback circuit comprises:

a buffering circuit, coupled to the first power terminal, having an input terminal coupled to the inverter chain circuit to receive the first control signal and an output terminal coupled to the first node, wherein when the first power terminal receives the first voltage and the second power terminal receives the second voltage, the voltage level at the first node is changed to be equal to a voltage level of the first control signal.

6. The power-on control circuit as claimed in claim 5, wherein the feedback circuit further comprises:

a transmission gate coupled between the output terminal of the buffering circuit and the first node and controlled by the first control signal, wherein when the first power terminal receives the first voltage and the second power terminal receives the second voltage, the transmission gate is turned on, and wherein when the first power terminal receives the first voltage and the second power terminal does not receive the second voltage, the transmission gate is turned off.

7. The power-on control circuit as claimed in claim 5, wherein the feedback circuit further comprises:

a transmission gate coupled between the inverter chain circuit and the input terminal of the buffering circuit and controlled by the first control signal, wherein when the first power terminal receives the first voltage and the second power terminal receives the second voltage, the transmission gate is turned on, and wherein when the first power terminal receives the first voltage and the second power terminal does not receive the second voltage, the transmission gate is turned off.

8. The power-on control circuit as claimed in claim 1, wherein the inverter chain circuit comprises a first inverting circuit and a second inverting circuit which are coupled in series, and wherein an input terminal of the first inverting circuit is coupled to the first node, and the first control signal is generated at an output terminal of the second inverting circuit.

9. The power-on control circuit as claimed in claim 8, wherein the inverter chain circuit further comprises:

a third inverting circuit coupled to the output terminal of the second inverting circuit, and a feedback circuit, coupled to the inverter chain circuit and the first node, receiving the first control signal and a second control signal, wherein the second control signal is generated at an output terminal of the third inverting circuit, and the second control signal is the inverse of the first control signal, and wherein when the first power terminal receives the first voltage and the second power terminal receives the second voltage, the feedback circuit is controlled by the first control signal and the second control signal to change a voltage level at the first node according to the first control signal, and the inverter chain circuit cuts off a leakage current according to the changed voltage level at the first node.

10. The power-on control circuit as claimed in claim 1, further comprising:

a resistor coupled between the switch circuit and the first node.

11. An input/output control circuit, coupled to an input/output pad and comprising:

a first power terminal reconfigured to receive a first voltage;

a second power terminal reconfigured to receive a second voltage;

an output stage circuit coupled to the input/output pad and the first power terminal and controlled by a first control signal; and a power-on control circuit coupled to the output stage circuit and configured to generate the first control signal, wherein the power-on control circuit comprises:

a switch circuit having a control terminal receiving the first control signal, an input terminal coupled to the second power terminal, and an output terminal coupled to a first node;

an inverter chain circuit, coupled to the first power terminal, having an input terminal coupled to the first node and generating the first control signal; and a capacitor coupled between the first node and a ground, wherein when the first power terminal receives the first voltage and the second power terminal does not receive the second voltage, the switch circuit is turned on according to the first control signal, and wherein when the first power terminal receives the first voltage and the second power terminal receives the second voltage, the switch circuit is turned off according to the first control signal.

12. The input/output control circuit as claimed in claim 11, wherein the first voltage is higher than the second voltage.

13. The input/output control circuit as claimed in claim 11, wherein the switch circuit comprises a P-type transistor, and wherein a bulk of the P-type transistor is coupled to the first power terminal, and a gate, a source, and a drain of the P-type transistor are coupled to the control terminal, the input terminal, and the output terminal of the switch circuit, respectively.

14. The input/output control circuit as claimed in claim 11, wherein the power-on control circuit further comprises:

a feedback circuit, coupled to the inverter chain circuit and the first node, receiving the first control signal, wherein when the first power terminal receives the first voltage and the second power terminal receives the second voltage, the feedback circuit changes a voltage level at the first node according to the first control signal, and the inverter chain circuit cuts off a leakage current according to the changed voltage level at the first node.

15. The input/output control circuit as claimed in claim 14, wherein the feedback circuit comprises:

a buffering circuit, coupled to the first power terminal, having an input terminal coupled to the inverter chain circuit to receive the first control signal and an output terminal coupled to the first node, wherein when the first power terminal receives the first voltage and the second power terminal receives the second voltage, the voltage level at the first node is changed to be equal to a voltage level of the first control signal.

16. The input/output control circuit as claimed in claim 15, wherein the feedback circuit further comprises:

a transmission gate, coupled between the output terminal of the buffering circuit and the first node and controlled by the first control signal, wherein when the first power terminal receives the first voltage and the second power terminal receives the second voltage, the transmission gate is turned on, and wherein when the first power terminal receives the first voltage and the second power terminal does not receive the second voltage, the transmission gate is turned off.

17. The input/output control circuit as claimed in claim 15, wherein the feedback circuit further comprises:

a transmission gate coupled between the inverter chain circuit and the input terminal of the buffering circuit and controlled by the first control signal, wherein when the first power terminal receives the first voltage and the second power terminal receives the second voltage, the transmission gate is turned on, and wherein when the first power terminal receives the first voltage and the second power terminal does not receive the second voltage, the transmission gate is turned off.

18. The input/output control circuit as claimed in claim 11, wherein the inverter chain circuit comprises a first inverting circuit and a second inverting circuit which are coupled in series, and wherein an input terminal of the first inverting circuit is coupled to the first node, and the first control signal is generated at an output terminal of the second inverting circuit.

19. The input/output control circuit as claimed in claim 18, wherein the inverter chain circuit further comprises a third inverting circuit coupled to the output terminal of the second inverting circuit, wherein a second control signal is generated at an output terminal of the third inverting circuit, the second control signal is the inverse of the first control signal, and the output stage circuit is controlled further according to the second control signal, wherein the power-on control circuit further comprises a feedback circuit, coupled to the inverter chain circuit and the first node, receiving the first control signal and the second control signal, and wherein when the first power terminal receives the first voltage and the second power terminal receives the second voltage, the feedback circuit is controlled by the first control signal and the second control signal to change a voltage level at the first node according to the first control signal, and the inverter chain circuit cuts off a leakage current according to the changed voltage level at the first node.

20. The input/output control circuit as claimed in claim 11, wherein the power-on control circuit further comprises:

a resistor coupled between the switch circuit and the first node.

21. The input/output control circuit as claimed in claim 11, wherein the inverter chain circuit further generates a second control signal, and the second control signal is the inverse of the first control signal, wherein the output stage circuit comprises:

a first first-type transistor having a control electrode receiving the first control signal, an input electrode coupled to the first power terminal, and an output electrode coupled to a second code;

a first second-type transistor having a control electrode receiving the second control signal, an input electrode coupled to a third node, and an output electrode coupled to the ground, a second first-type transistor having a control electrode coupled to the second node, an input electrode coupled to the first power terminal, and an output electrode coupled to the input/output pad; and a second second-type transistor having a control electrode coupled to the third node, an input electrode coupled to the input/output pad, and an output electrode coupled to the ground.

22. The input/output control circuit as claimed in claim 21, further comprising:

a gate control circuit coupled to the control electrode of the second first-type transistor and the control electrode of the second second-type transistor and further coupled to the second power terminal, wherein when the first power terminal receives the first voltage and the second power terminal receives the second voltage, the first first-type transistor and the first second-type transistor are turned off, and the second first-type transistor and the second second-type transistor are controlled by the gate control circuit.

* * * * *